US008272182B1

(12) United States Patent
Spiegel

(10) Patent No.: US 8,272,182 B1
(45) Date of Patent: Sep. 25, 2012

(54) FRAME UNIT AND METHOD

(75) Inventor: Marko Spiegel, LaFox, IL (US)

(73) Assignee: Conservation Technology International, Inc., LaFox, IL (US)

( * ) Notice: Subject to any disclaimer, the term of this patent is extended or adjusted under 35 U.S.C. 154(b) by 0 days.

(21) Appl. No.: 13/065,386

(22) Filed: Mar. 21, 2011

(51) Int. Cl.
*E04B 1/74* (2006.01)

(52) U.S. Cl. ..... 52/407.1; 52/404.2; 52/404.4; 52/586.1; 52/779; 52/745.1

(58) Field of Classification Search ..... 52/407.1, 52/407.3, 404.2–404.4, 481.1, 778, 779, 52/510, 586.1, 745.1, 293.3, 309.7, 145, 52/591.4, 582.1
See application file for complete search history.

(56) References Cited

U.S. PATENT DOCUMENTS

| | | | | |
|---|---|---|---|---|
| 2,548,576 | A | 4/1951 | Willson | |
| 3,332,194 | A * | 7/1967 | Jack | 52/591.1 |
| 3,353,315 | A | 11/1967 | Barker | |
| 3,991,252 | A | 11/1976 | Kolakowski et al. | |
| 4,269,006 | A | 5/1981 | Larrow | |
| 4,276,730 | A | 7/1981 | Lewis | |
| 4,510,726 | A | 4/1985 | MacDonald, Jr. | |
| 4,578,915 | A | 4/1986 | Schneller | |
| 4,586,304 | A | 5/1986 | Flamand | |
| 4,628,650 | A | 12/1986 | Parker | |
| 4,862,660 | A | 9/1989 | Raymond | |
| 5,067,296 | A * | 11/1991 | Brown et al. | 52/309.7 |
| 5,297,369 | A * | 3/1994 | Dickinson | 52/281 |
| 5,333,429 | A | 8/1994 | Cretti | |
| 5,581,969 | A | 12/1996 | Kelleher | |
| 5,617,700 | A | 4/1997 | Wright et al. | |
| 6,026,629 | A * | 2/2000 | Strickland et al. | 52/794.1 |
| 6,082,066 | A | 7/2000 | Mill | |
| 6,427,407 | B1 | 8/2002 | Wilson | |
| 6,571,523 | B2 | 6/2003 | Chambers | |
| 6,892,507 | B1 | 5/2005 | Pease | |
| 7,818,922 | B2 | 10/2010 | Ellis | |
| 2004/0006934 | A1 | 1/2004 | Heydon | |
| 2004/0200171 | A1 | 10/2004 | Schilger | |
| 2005/0076611 | A1 | 4/2005 | Crawford | |
| 2005/0204697 | A1 | 9/2005 | Rue | |
| 2005/0204699 | A1 | 9/2005 | Rue | |
| 2005/0284061 | A1 | 12/2005 | Ritchie | |
| 2006/0218869 | A1 | 10/2006 | Ellis | |
| 2008/0083180 | A1 | 4/2008 | Miller | |
| 2009/0056255 | A1 * | 3/2009 | Barton | 52/309.7 |
| 2009/0235598 | A1 | 9/2009 | Miller | |
| 2010/0281784 | A1 | 11/2010 | Leo | |

* cited by examiner

*Primary Examiner* — Brian Glessner
*Assistant Examiner* — Brian D Mattei
(74) *Attorney, Agent, or Firm* — Ryndak & Suri LLP

(57) ABSTRACT

An insulated frame unit for enclosing a wall to provide a highly insulated and airtight wall is provided. The frame unit includes a panel that is formed from a rigid insulated composition such as an expanded foam composition. The panels can be mounted to a wall frame in rows and columns to enclose the wall, and may include outwardly extending flanges that can cooperate with a flange of an adjacent frame unit to provide a stud-receiving opening into which a stud is inserted when mounting the frame units to the frame of the building. The frame unit is mountable to the frame with the interior side of the stud extending from the inner side of the frame unit so that adequate space is provided between the inner side of the frame unit and an interior finish member mounted to the interior side of the studs.

18 Claims, 7 Drawing Sheets

FRAME UNIT AND METHOD

FIELD OF THE INVENTION

This invention relates to a building product and method for constructing a wall of a building.

BACKGROUND OF THE INVENTION

A need exists for an improved building product and method for constructing an efficiently insulated and airtight wall for a building.

SUMMARY OF THE INVENTION

In accordance with the present invention an insulated frame unit is provided for use in constructing an exterior wall of a building that has an exterior finish member for the exterior of the building and an interior finish member for the interior room that is defined by the wall. The wall includes a plurality of spaced apart generally vertical studs, the studs having an exterior side facing the exterior of the building and an opposed interior side facing the interior room. The studs have a generally predetermined thickness, predetermined width, and spacing between the studs of at least about 12 inches. The frame unit comprises a panel composed substantially of a rigid insulating material, and the panel has first and second generally opposed ends, and third and fourth generally opposed ends, an inner side and an outer side. The panel also includes at least two stud-receiving openings in the inner side of the panel. The stud-receiving openings are generally parallel to each other and extend between the first and second ends of the panel. The stud-receiving openings have a width that is sufficient to allow a stud to be mounted within the stud-receiving openings. The stud-receiving openings have a depth that is less than the predetermined width of the stud, so that when the exterior side of the stud has been fully inserted into the stud-receiving opening, the interior side of the stud is spaced away from the inner side of the panel to provide a service chamber between the inner side of the panel and an interior finish member secured to the interior side of the studs. An exterior finish member can be secured proximate to the outer side of the panel.

In accordance with another aspect of the present invention an insulated frame unit for use in constructing an exterior wall of a building that has an exterior of the building and an interior room that is defined by the wall is provided. The wall includes a plurality of spaced apart generally vertical studs. The studs have an exterior side facing the exterior of the building and an opposed interior side facing the interior room. The studs having generally predetermined thickness, predetermined width, and spacing between the studs greater than about twelve inches. The frame unit comprises a panel composed substantially of a rigid insulating material. The panel has a body with first and second generally opposed ends, and third and fourth generally opposed ends, and the panel has an inner side and an outer side. The panel has at least first and second stud-receiving openings in the inner side of the panel. The first stud-receiving opening is a slot in the inner side of the panel that is spaced from the third and fourth sides of the body of the panel. The second stud-receiving opening is located along the fourth end of the panel. The stud-receiving openings are generally parallel to each other and extend between the first and second ends of the panel. The stud-receiving openings have a width that is sufficient to allow a stud to be mounted within the stud-receiving openings. The panel has a first flange extending outwardly from the third end of the body of the panel adjacent the inner side of the panel, and a second flange extending outwardly from the fourth end of the body of the panel adjacent the outer side of the panel. The length of the second flange is greater than the length of the first flange.

In accordance with a further aspect of the invention an exterior wall construction for a building is provided. The exterior wall construction comprises a frame having a plurality of spaced apart generally parallel studs. The studs have an exterior side facing the exterior of the building and an opposed interior side facing the interior of the building. The studs have a generally predetermined thickness, predetermined width, and spacing between the studs of at least about 12 inches. The construction has a first and a second insulated frame unit. Each insulated frame unit comprises a panel composed substantially of rigid insulating material. The panel has first and second generally opposed ends, and third and fourth generally opposed ends, an inner side and an outer side. The panel includes a stud-receiving opening in the inner side of the panel. The stud-receiving opening has a stud positioned therein with the interior side of the stud spaced inwardly from the inner side of the panel. The first insulated frame unit is positioned adjacent the second insulated frame unit. An interior finish member is secured to the interior side of the stud. The interior finish member is spaced from the inner side of the panel to provide a service chamber between the inner side of the panel and the interior finish member.

In accordance with a further aspect of the invention an exterior wall construction for a building is provided. The exterior wall construction comprises a frame having a plurality of spaced apart generally parallel studs. The studs have an exterior side facing the exterior of the building and an opposed interior side facing an interior of the building, and the studs have a generally predetermined thickness, predetermined width, and spacing between the studs of at least about 12 inches. The wall construction includes a first and a second insulated frame units. Each of the insulated frame units comprises a panel composed substantially of rigid insulating material. The panel has a body with first and second generally opposed ends, and third and fourth generally opposed ends. The panel has an inner side and an outer side, a first flange extending outwardly from the third end of the body of the panel adjacent the inner side of the panel, and a second flange extending outwardly from the fourth end of the body of the panel adjacent the outer side of the panel. The length of the second flange is greater than the length of the first flange. The first insulated frame unit is positioned adjacent the second insulated frame unit so that the third side of the panel of the first insulated frame unit is adjacent the fourth side of the panel of the second insulated frame unit. The second flange of the second insulated frame unit overlaps the first flange of the first insulated frame unit to thereby provide a stud-receiving opening. The stud-receiving opening has a stud positioned therein.

In accordance with still another aspect of the invention a method of constructing an exterior wall of a building having a frame is provided. The frame has a plurality of spaced apart generally parallel studs, the studs having an exterior side facing the exterior of the building and an opposed interior side facing an interior of the building. The studs have a generally predetermined thickness, predetermined width, and spacing between the studs of at least about 12 inches. The method comprises providing a plurality of insulated frame units. Each of the insulated frame units comprises a panel composed substantially of rigid insulating material. The panel has first and second generally opposed ends, and third and fourth generally opposed ends, an inner side and an outer side. The panel includes a stud-receiving opening in the inner side of the panel. The method includes installing the plurality of insulated frame units onto the frame to enclose the frame. The frame units are installed by installing an insulated frame unit onto the frame by positioning the exterior side of the stud within the stud-receiving opening in the inner side of the panel and with the interior side of the stud spaced from the inner side of the panel. An interior finish member is installed to the interior side of the stud with the interior finish member spaced from the inner side of the panel to provide a service chamber between the inner side of the panel and the interior finish member.

In accordance with still another aspect of the invention a method of constructing an exterior wall of a building having a frame is provided. The frame has a plurality of spaced apart generally parallel studs. The studs have an exterior side facing the exterior of the building and an opposed interior side facing the interior of the building. The studs have a generally predetermined thickness, predetermined width, and spacing between the studs of at least about 12 inches. The method comprises providing a plurality of insulated frame units. Each of the insulated frame units comprises a panel composed substantially of rigid insulating material. The panel has a body with first and second generally opposed ends, and third and fourth generally opposed ends. The panel has an inner side and an outer side, a first flange extending outwardly from the third end of the body of the panel adjacent the inner side of the panel, and a second flange extending outwardly from the fourth end of the body of the panel adjacent the outer side of the panel. The length of the second flange is greater than the length of the first flange. The method includes positioning a first insulated frame unit adjacent a second insulated frame unit so that the third side of the panel of the first insulated frame unit is adjacent the fourth side of the panel of the second frame unit. The second flange of the panel of the second insulated frame unit overlaps the first flange of the panel of the first insulating frame unit. The overlapping of the second flange of the second insulated frame unit with the first flange of the first frame unit forms a stud-receiving opening. A stud is positioned within the stud-receiving opening. At least one of the first and second insulated frame units is secured to the stud.

In accordance with another aspect of the invention an insulated frame unit is provided that can be used to construct an exterior wall that provides a high level of insulation and airtightness.

In accordance with another aspect of the invention an insulated frame unit is provided that has a design that is easily scalable to provide insulating properties for various different climate zones.

Other advantages and features of the invention will become apparent from the following description and from reference to the drawings.

DETAILED DESCRIPTION

Figure 1:
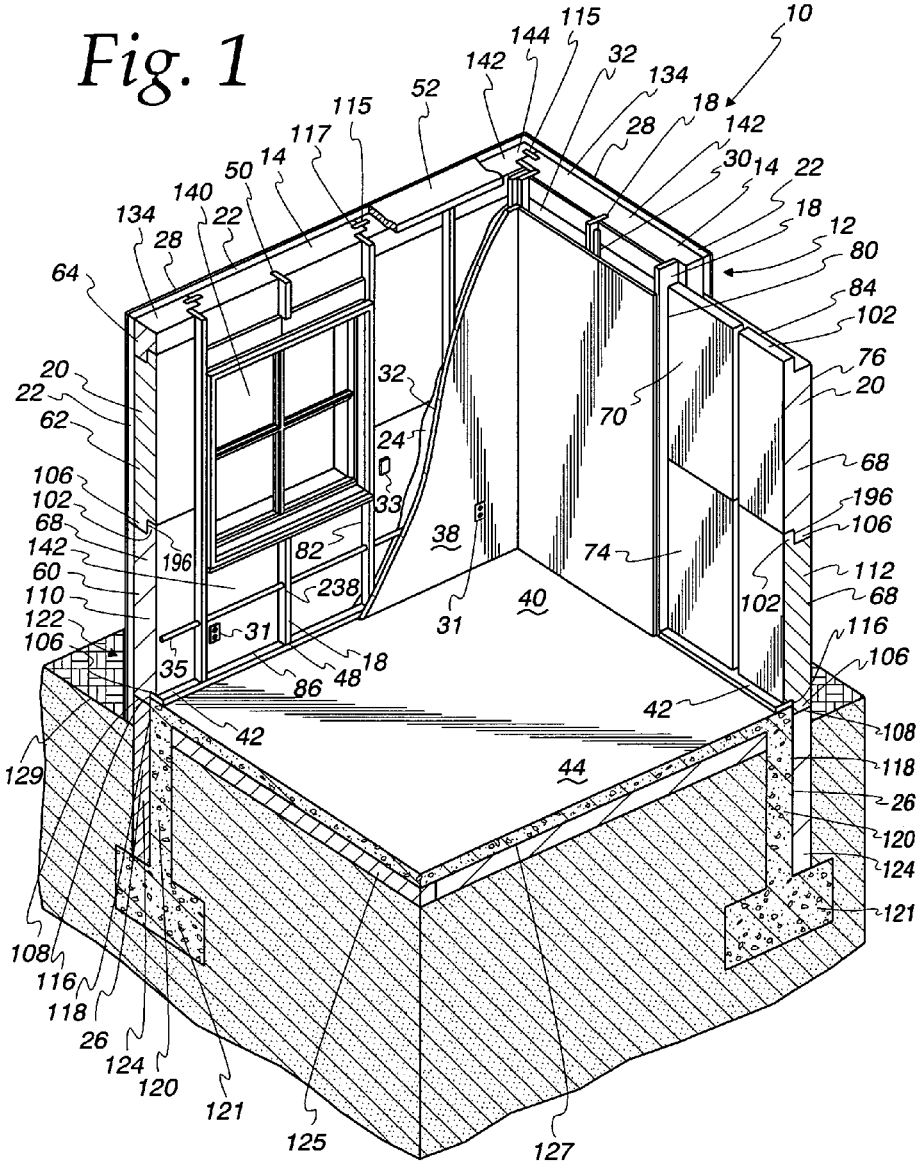
FIG. 1 is a perspective view of an interior side of a building illustrating a wall construction in accordance with the present invention.

While this invention is susceptible of embodiment in many different forms, there are shown in the drawings and described in detail herein, several specific embodiments with the understanding that the present disclosure is to be considered as exemplifications of the principles of the invention and is not intended to limit the invention to the embodiments illustrated.

The present invention relates to the construction of a building that has superior insulating and air infiltration reduction properties. These objectives are achieved while at the same time also achieving reduced onsite construction costs and construction times. Moreover, the utilization of the building products and methods of the present invention can be used in concert with building framing methods that are already familiar to tradesmen, such as, for example, a platform framing process.

Figure 2:
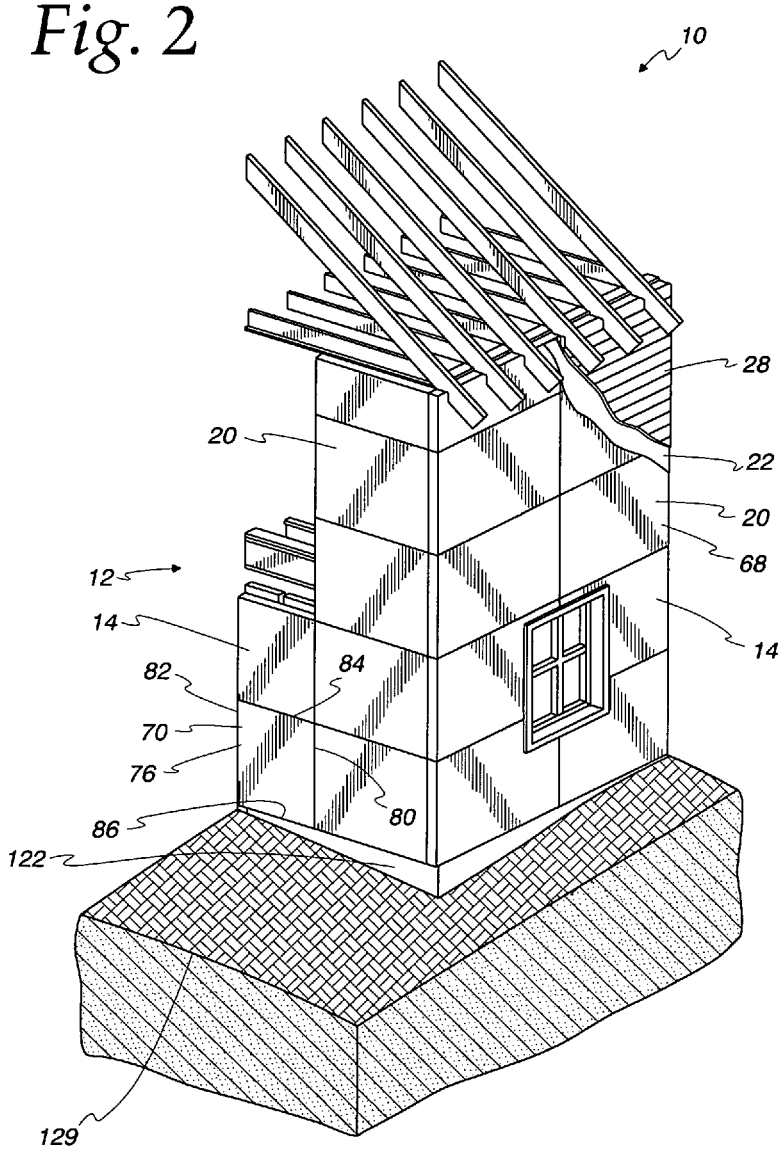
FIG. 2 is a perspective view of an exterior side of a building illustrating a wall construction in accordance with the present invention.

Referring to FIGS. 1 and 2, building 10 is shown with a building shell frame 12 constructed of wood framing. The frame 12 of building 10 has exterior walls 14 that include wood studs 18. A plurality of insulated frame units 20 of the present invention are shown installed on studs 18 of exterior walls 14 to thereby enclose and insulate exterior walls 14. Frame units 20 can be mass produced offsite to reduce labor costs, and then shipped to the construction site. At the construction site, frame units 20 can be installed to form walls 14 with reduced labor costs and construction times. Importantly, frame units 20 are designed to form a highly insulated building wall 14 while using a single relatively thick continuous insulation layer of a rigid material, for example, expanded polystyrene foam with a thickness of about 5-8 inches or greater. This approach is in contrast to attempting to increase the insulating efficiency of a wall design that has an interior layer of insulation, by adding an additional and separate exterior layer of insulation. A wall construction using separate exterior and interior insulation layers has an increased risk of experiencing problems related to vapor condensation. Vapor condensation that occurs between the insulating layers can lead to premature building decay, possible mold formation and the deterioration of the insulation layers. Frame units 20 of the present invention achieve a high level of insulating efficiencies while avoiding the aforementioned condensation related problems. Also, by using a single relatively thick layer of insulation, the cost of installing separate inside and outside insulation layers is avoided.

It is additionally noted that frame units 20 can be manufactured to have different thicknesses for the insulating layer of a panel 68 that is included in frame units 20. This allows frame units 20 to be easily scaled to appropriately meet the varying insulating requirements for buildings constructed in different climate zones. Importantly, by interlocking the insulating panel 68 with studs 18 and frame 12, a thick layer of insulation can be attached to thereby construct highly insulated building walls. It is further noted that the rigid insulating material of panel 68 of frame units 20 preferably straddles the vertical plane of the foundation wall 26. Thus, the use of a relatively thick layer of the rigid insulating material need not unduly reduce interior room space or unduly impact the aesthetic appearance of the exterior of the building. It is further noted that frame units 20 may optionally include an exterior sheathing 22 and/or an interior sheathing 24. Optional exterior sheathing 22 is useful for attaching certain types of an exterior finishing member 28, such as, for example, wood siding. Optional interior sheathing 24 can be secured to studs 18, such as by brackets 30 to thereby increase building rigidity against shear force and also to provide a fire barrier. Additionally, or alternatively, a protective fire retardant can optionally be applied to panel 68. Sheathing 22, 24 may be any suitable material, for example OSB board or plywood. Sheathing 22, 24 typically is secured to panel 68 by adhesive.

Importantly, frame units 20 are configured for mounting to frame 12 of building 10 in a manner that provides a service chamber 32 for installing electrical boxes, electrical switches, wiring and the like. Chamber 32 is located between frame member 20 and an interior finish member 38 attached to stud 18. Interior finish member 38 may be any customary interior finish member such as, for example, dry wall, paneling or plaster. Chamber 32 preferably has a depth that provides sufficient space for the installation of electrical outlet boxes and electrical switch boxes, and to provide adequate space for installing conduit, wiring, cable, plumbing and other such utility services. Typically, chamber 32 is preferably sized to provide at least about a 2 inch space between frame units 20 and interior finish member 38. For most residential building construction, chamber 32 preferably has a space of about 2 to about 3 inches.

In one aspect of the invention, studs 18 are conventional wood lumber, such as for example 2×4, 2×6 or 2×8 wood studs, although the present invention may be also practiced with other stud sizes. Larger studs, 2×10 or 2×12 studs, for example, may be used when scaling frame units 20 for climate zones requiring higher insulating properties. By way of reference, 2×4, 2×6 and 2×8 studs typically have a nominal thickness of about 1⅝ inches. 2×4, 2×6 and 2×8 studs have typical nominal width dimensions of about 3⅝ inches, 5⅝ inches and 7⅝ inches, respectively. One typical height, or length, for a stud is 8 feet. Typically, this height is used for interior rooms 40 that have a ceiling height of about eight feet. Nine foot long, or longer, studs can be used when higher ceiling heights are desired. Frame units 20 of the present invention are easily adaptable for use with studs 18 of other heights, widths or thicknesses. The framing for walls 14 typically includes a horizontal sole plate, or sill, 42 that is secured to a floor 44 of building 10. As best seen in FIG. 1, a bottom end 48 of stud 18 is secured to a sill 42 while a top end 50 of stud 18 is secured to a horizontal top plate 52. Customarily, studs 18 are secured in place by nailing to sill 42 and top plate 52. Studs 18 are typically laid out with a predetermined spacing therebetween of at least about 12 inches, for example, a stud spacing of about 16 inches on center, or about 24 inches on center. For the exemplary wood framing illustrated in FIG. 1, 2x6 studs 18 are laid out with a spacing of 24 inches between the centerlines of studs 18. The height of exemplary studs 18 as shown in FIG. 1 is approximately 9 feet.

Figure 4:
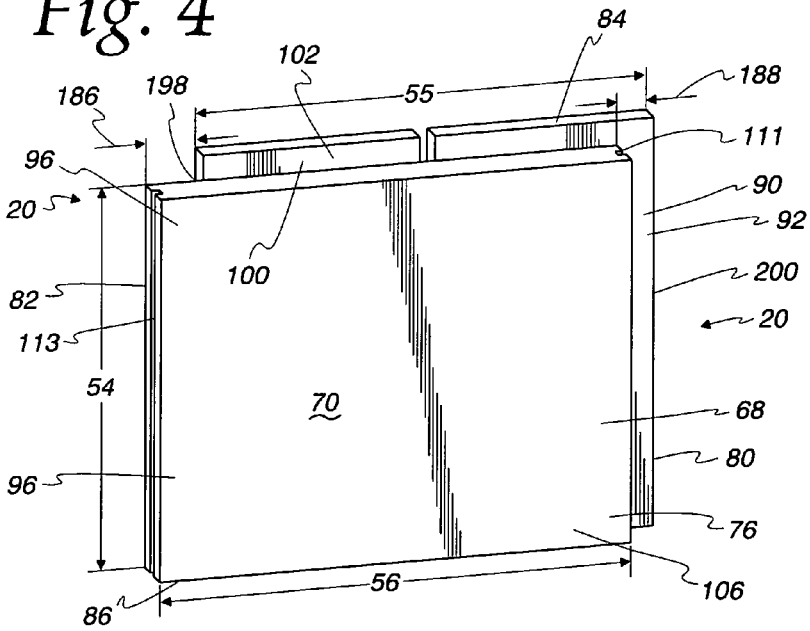
FIG. 4 is a perspective view of the outer side of a frame unit in accordance with the present invention.

Referring to FIGS. 1 and 4, exemplary frame units 20 have a height 54 for outer side 76 of panel 68 that is 4 feet, and a width 56 that is also 4 feet. It is noted the width 55 along the inner side 74 of panel 68 is smaller than width 56. Typically, width 56 will be greater than width 55 by an amount equal to the thickness of one stud 18, i.e., two times one-half the thickness of studs 18. The height of the inner side 74, like outer side 76, is 4 feet for exemplary frame unit 20. Such a size for frame units 20 allows for relatively easy handling of frame unit 20 during installation of frame units 20 to form walls 14. It being understood, however, that frame units 20 may be formed with various other dimensions, including, for example, 4 feet by 8 feet, or 8 feet by 4 feet. Also, for a room that has a ceiling height of 9 feet, for example, a 4-foot high frame unit 20 may be vertically stacked with a 5-foot high frame unit 20. Alternatively, if desired, two or more frame units 20 of various heights can be vertically stacked to the ceiling height of the room. As can be appreciated by viewing FIG. 1, interior room 40 has a ceiling height that exceeds 8 feet. The frame of exterior wall 14 is enclosed by vertically stacking a 4-foot high bottom frame unit 60, a 4 foot high second frame unit 62 and a third 1-foot high frame unit 64 positioned above frame unit 62 for the nine-foot ceiling height of room 40. Alternatively, as can be appreciated by viewing FIG. 2, exterior wall 14 may be constructed by primarily using 4-foot high panels. In this instance, frame units 20 would need modification to be adapted, for example, for fitting the framing configuration adjacent the first and second stories of building 10. As discussed later in detail, typically, frame units 20 are separately installed one at a time at the construction site. Alternatively, frame units 20 could be assembled to form a whole wall, or a section of a wall, that is then shipped to the building construction site and used to construct walls 14 and building 10.

Figure 3:
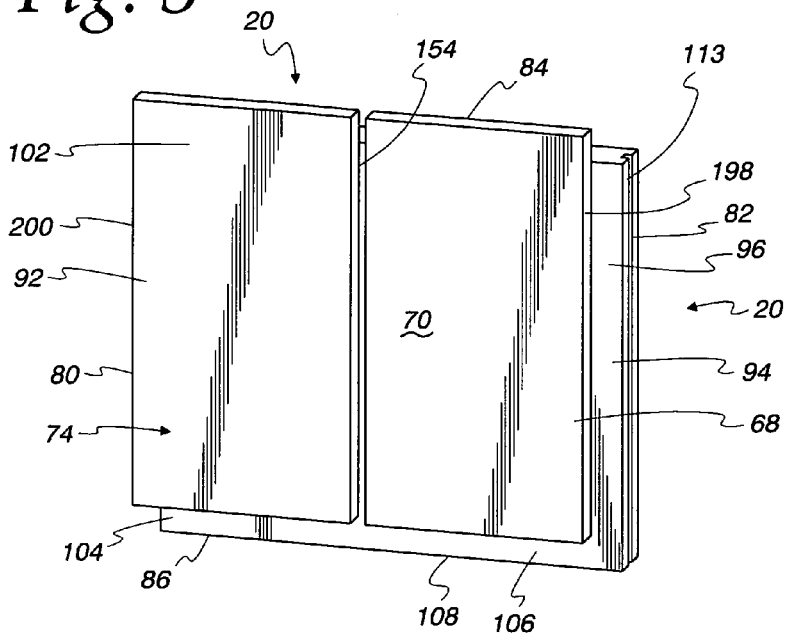
FIG. 3 is a perspective view of the inner side of a frame unit in accordance with the present invention.
Figure 5:
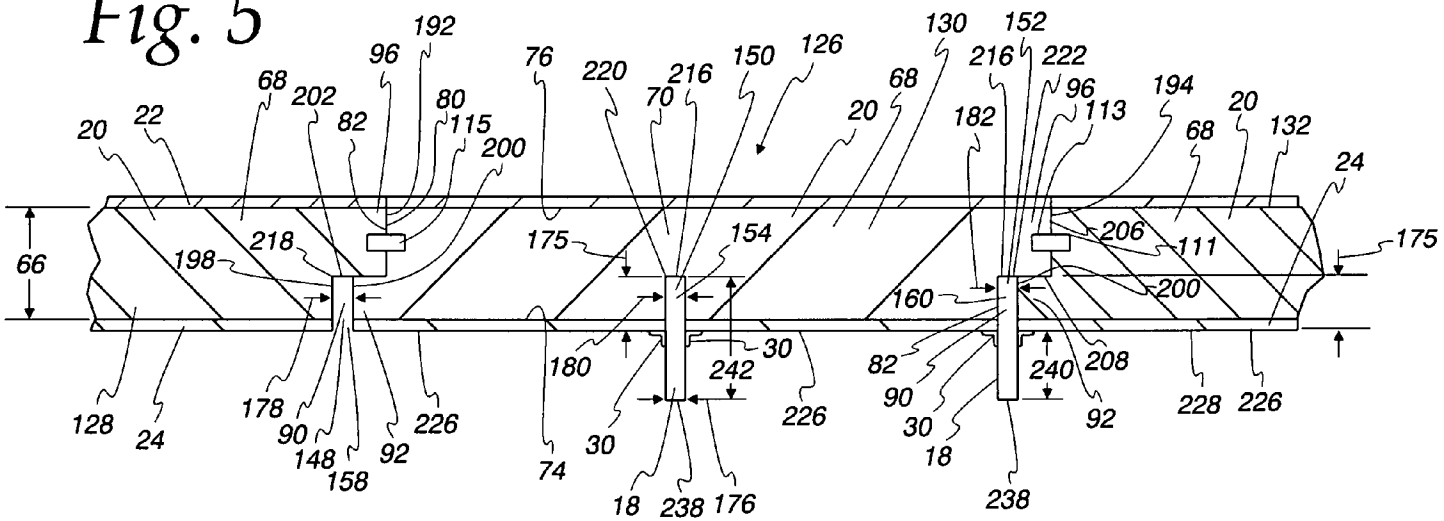
FIG. 5 is a fragmentary top sectional view of three frame units positioned side by side in a row.

As best seen in FIGS. 3-5, the frame unit 20 includes a rigid insulating panel 68. Panel 68 may be formed from any suitable rigid insulating material. For example, panel 68 may be formed of a composition of foam, such as expanded polystyrene foam. Expanded polystyrene has an R value of approximately 4.6 per inch of thickness and has additional desirable structural strength properties. Thus, the thickness 66 of panel 68 can be readily scaled to provide walls 14 with R values on the order of 20, 30, 40, 60 or greater as required for the climate zone in which building 10 is located. Panel 68 can be formed by any suitable method. For example, panel 68 may be molded, or may be cut from a larger block of rigid insulating material to form panel 68 of a desired size and configuration. Panel 68 has a body 70 with typically a generally flat inner side 74, and typically a generally flat outer side 76. When viewed from inner side 74, body 70 has a left side end 80 and an opposite right side end 82. Body 70 of panel 68 of frame unit 20 also has a top end 84 and an opposite bottom end 86. A recess 90 in outer side 76 extends along left side end 80 to form an inner left flange 92 at left side end 80. Similarly, a recess 94 in inner side 74 along right side end 82 forms an outer right flange 96 at right side end 82 of panel 68 of frame unit 20. As best seen by viewing FIGS. 3 and 4, a recess 100 in outer side 76 extends along top end 84 to form an inner top flange 102 at top end 84. Similarly, a recess 104 in inner side 74 along bottom end 86 of panel 68 of frame unit 20 forms outer bottom flange 106 at bottom end 86 of panel 68. As will be discussed below in detail, outwardly extending flanges 92, 96, 102 and 106 of one frame unit 20 are used to respectively overlap with an adjacent flange 96, 92, 106 or 102 on a panel 68 of an adjacently positioned frame unit 20. Panel 68 also may include a seal recess 111 and a seal recess 113. When panels 68 are positioned side by side, recesses 111, 113 cooperate to form a channel 117 into which an elastic seal member 115 is held to extend from top end 84 to bottom end 86 of panels 68. To alternatively inhibit airflow through the junction of side by side panels 68, the channel formed by recesses 111, 113 may be injected on site with a sealing compound after panels 68 are positioned side by side.

Multiple frame units 20 may be horizontally installed side by side to form a row of frame units 20. As will be discussed in detail below, when frame units 20 are positioned in a row, inner left flanges 92 and outer right side flanges 96 are provided with lengths that allow them to cooperate with an adjacent frame unit 20 to form a space into which stud 18 may be received. Multiple frame units 20 may also be vertically stacked in a column. When stacked in a column, bottom flange 106 of an upper frame unit 20 overlaps with top flange 102 of the adjacent lower framed unit 20. Thus, columns and rows of frame units 20 can be installed so that frame units 20 abut, overlap and interlock with each other to thereby enclose a framed exterior wall 14 to provide a highly insulated and airtight wall. It is also noted that when a frame member 20 is positioned adjacent sill 42, such as those indicated as frame units 110 and 112 in FIG. 1, bottom outer flange 106 overhangs sill 42. Preferably, bottom outer flange 106 extends in close engagement along outer edge 116 of sill 42, and in close engagement along the outer surface 118 of foundation wall 120 supported on footing 121. This provides a highly insulated and airtight wall 14 adjacent the bottom area 122 of wall 14. It is also noted that building 12 may include a separate additional foam insulation member 124 that abuts against the bottom 108 of flange 106 and extends downward along outer surface 118 of foundation wall 120. As shown in FIG. 1, an additional foam insulating member 125 is provided to insulate the bottom 127 of exemplary concrete slab floor 44. The grade of the building site is indicated at 129.

In one embodiment of the invention, certain frame units 20 may be considered as a standard type or typical frame unit 20. A standard type frame unit 20 has a basic size and configuration that typically allows it to be used to enclose a majority of wall 14 of the building 12. Non-standard frame units 134 are those frame units 20 that need to be used to enclose an area of the framed wall 14 where a standard frame unit 20 would be too large or too small to fit the desired space. Non-standard frame unit 20 also typically would be used in certain areas of a framed wall 14, such as, for example, exemplary non-standard frame units 142 used adjacent a window opening 140 location, adjacent a corner 144 of an interior room 40, adjacent a doorway, or at other locations where a full-sized standard size framing unit 20 would not fit, or otherwise require modification to fit building frame 12. Often, non-standard frame units 134 may be formed simply by trimming down a standard frame unit 20 to a required size. In some instances, a standard frame unit 20 may even be trimmed to a width wherein only one of stud receiving openings 148, 150 or 152 remains on the trimmed down frame unit 20. Such as, for example, a non-standard frame unit having only stud-receiving slot 154 for mounting to one of studs 18, which might be used, for example, for enclosing a relatively narrow area of wall 14. In other instances, a non standard frame unit 134 may have a somewhat modified configuration from that of a standard frame unit 20, such as frame units 142 adapted for use at corner 144, as explained later in greater detail.

FIG. 5 is provided to illustrate cooperation of standard frame units 20 when mounted horizontally side-by-side in a row for enclosing a portion 126 of wall 14 of building 12. For purposes of aiding in the description, the row of horizontally mounted identical frame units 20 have been additionally numbered as a left frame unit 128, a center frame unit 130 and right frame unit 132. For clarity, one stud 18 and interior finish member 38 have been omitted. In FIG. 5 there can be seen three stud-receiving openings 148, 150, 152 for receiving studs 18 used to frame wall 14. Stud-receiving opening 150 may be provided as a slot 154, while stud-receiving openings 148 and 152 are provided as stud-receiving channels 158 and 160, respectively. Stud-receiving channel 158 is formed by the cooperation of flanges 92 and 96 at the left side of center frame unit 130. Stud-receiving channel 160 is formed by the cooperation of flanges 92 and 96 at the right side of center frame unit 130. Typically, stud-receiving openings 148, 150 and 152 are all generally vertical and substantially parallel to each other.

In exemplary frame unit 20 shown in FIG. 5, panel 68 has a single slot 154 centrally located along width 55 of inner side 74 of panel 68. Thus, when a panel with a width 56 of 4 feet is used in conjunction with studs 18 framed at 24 inches on center, stud-receiving channel 158, slot 154 and stud-receiving channel 160 will respectively be aligned for mounting engagement with three studs 18. Two of those three studs 18 are shown as studs 170 and 172. A stud 18 which is inserted into left stud-receiving opening 148 is omitted for clarity. It is understood, however, that if panel 68 is wider than four feet, if necessary, such wider panel would be formed to have enough additional slots 154 to cooperate with any of the additional studs 18 to which such wider panel 68 is intended to be mounted. For example, for a frame unit 20 that is eight feet wide, panel 68 might be mounted on a row of 5 spaced apart studs 18 that are framed on 24 inch centers to span eight feet. Thus, such wider panel 68 of wider frame unit 20 would be provided with three stud-receiving slots 154. The three stud-receiving slots 154 would be aligned for insertion on the three interior studs 18 of the row of five studs 18. The stud-receiving channels 158 and 160 would be positioned for alignment with the end studs 18 of the row of five studs 18. Stud-receiving channels 158 and 160 would be formed as described previously, i.e. by flanges 92 and 96 of panel 68 and their respective cooperation with flanges 96 and 92 of panels 68 of the adjacent frame units 20 that are placed side by side with the wider frame unit 20. A 4-foot wide panel 68 may also have more than one slot 154 in certain other framing applications, such as where studs are framed in on 16-inch centers. For example, a 4-foot wide panel for mounting on studs 18 framed at 16-inch centers would have two slots 154 for mounting on the interior 2 studs of the row of 4 studs spanning 48 inches.

It is noted that stud-receiving openings 148, 150, 152 have widths 178, 180 and 182, respectively, which are sized to at least allow the nominal thickness 176 of the stud 18 to be received therein. For example, when studs 18 have a nominal thickness 176 of 1½ inches, the widths of stud-receiving openings 148, 150, and 152 are at least about 1½ inches or greater. Preferably, widths 178, 180 and 182 are about 1½ inches. A 1½ inch width for stud-receiving openings 148, 150, 152 provides a surface contact with stud 18 to provide an airtight fit. In the case of slot 154, the 1½ inch width can provide an interference fit between slot 154 and stud 18 inserted therein. This interference fit helps hold a frame unit 20 in place at stud 18 by friction during the process of installing frame units 20 onto the studs 18 to enclose exterior walls 14.

In now describing stud-receiving channels 158 and 160 in greater detail, it is first noted that stud-receiving channels 158 and 160 are typically substantially identical to each other and are formed in the same manner. Formation of channels 158, 160 occurs when outer flange 96 is positioned to overlap with inner flange 92. As indicated in FIG. 4, outer flange 96 has a length 186 that is greater than the length 188 of inner flange 92. Length 186 of outer flange 96 may be, for example, about 4 inches. The length 188 may be, for example, about 2½ inches. Such dimensioning would result in a width of about 1½ inches for stud-receiving channels 158, 160. Stated another way, the difference in lengths of the flanges 96 and 92 at the junction 192 between panels 68 of frame units 128 and 130, is the width 178 of stud-receiving opening 148. Likewise, the difference in lengths of the flanges 96 and 92 is the width 182 of stud-receiving opening 152 at the junction 194 between panels 68 of frame units 130 and 132. The difference in lengths of flanges 96 and 92 may be substantially the same as predetermined width 176 of stud 18 that is to be mounted in stud-receiving channel 158 or 160, to thereby provide an air-tight fit against stud 18. For some framing applications, it may be advantageous to form the length of flanges 92 and 96 so as to yield different widths for channels 158, 160.

Thus, stud-receiving channel 158 is defined by edge 198 of recess 94, edge 200 of left inner flange 92, and a surface 202 of right outer flange 96. It is also noted that junction 192 and junction 194 between abutted frame units 128 and 130, and 130 and 132, respectively, do not directly transverse in a straight line from outer side 76 to inner side 74 of panels 68. Instead, junctions 192 and 194 follow a stepped path having a leg 206 and a leg 208. These stepped junctions 192 and 194 provide a number of advantages. First, each stepped junction 192, 194 provides increased surface area for sealing contact along the junctions 192, 194. Secondly, the stepped junctions avoid a direct pathway from outer side 76 and inner side 74. This resists air infiltration directly along junctions 192, 194, such as may otherwise occur during periods of strong winds. It is additionally noted that the increased sealing surface area provided by stepped junctions 192 and 194, and their indirect paths, also reduces the loss of conditioned air from interior room 40 to the outside of walls 14. The same advantages are provided by a stepped junction 196, formed when outer bottom flange 106 of one frame unit 20, overlaps inner top flange 102 of another frame unit 20, such as when vertically stacking frame units 20, as shown in FIG. 1.

The depth 175 of the stud-receiving openings 148, 150, and 152, is another important aspect of the present invention. This is because the depth 175 of stud-receiving openings 148, 150 and 152, along with the width of stud 18 are the factors that determine the depth of service chamber 32. More specifically, depth 175 is the distance that stud 18 is inserted into stud-receiving openings 148, 150, 152, when stud 18 has been fully inserted therein to mount frame unit 20 to stud 18. In the configuration shown for stud-receiving openings 148, 150, 152, when stud 18 is fully inserted, the exterior side 216 of stud 18 abuts against a respective back side 218, 220, or 222 of stud-receiving channel 158, slot 154 and stud-receiving channel 160. Thus, depth 175 of stud-receiving openings 148, 150, 152 will be the distance from back side 218, 220, and 222 and the inner side 226 of frame unit 20. The inner side of frame unit 20 will be the inner side 228 of inner sheathing 24, when optional inner sheathing 24 is used. Preferably, interior sheathing 24 is provided for frame unit 20, and interior sheathing 24 is secured to studs 18 with brackets 30 to provide rigidity for the wall. As stated, depth 175 of stud-receiving opening 148, 150, and 152 is important to provide an adequate depth 234 (indicated in FIG. 7) for service chamber 32 between the inner side of frame member 20 and interior finish member 38. Interior finish member 38 may be any desired member, typically for example, drywall, plaster or wall paneling. The depth 234 for service chamber 32, generally will at least suffice to allow space for electrical boxes, such as for electrical outlets 31, light switches 33 and for meeting the depth requirements for providing other utility type services. The fact that frame unit 20 is interlocked and secured to the building frame allows rigid panel 68 to extend outwardly from the general vertical plane of outer surface 118 of outer foundational wall 120, which aids in allowing an adequate depth to be provided for service chamber 32. With the high R values provided with the frame members 20 and method of the present invention, it is not necessary to fill service chamber 32 with additional insulating materials. Therefore, such additional insulation need not be present where it would compete for space that is required by electrical outlet boxes 31, electrical light switch boxes 33, conduits 35, wiring, plumbing and other services. Instead, when exterior side 216 of stud 18 is fully inserted into stud-receiving opening 148, 150, or 152 the interior side 238 of stud 18 will extend spaced away from the inner surface of frame unit 20 a distance 240 and allow a generally unencumbered service chamber 32 to be provided. Distance 240 will be the width 242 of stud 18 less the depth 175 of the stud-receiving opening 148, 150, or 152 into which stud 18 is inserted. For example, a 2×6 stud 18 having a nominal width of 5½ inches, inserted into a stud-receiving opening 148 having a depth 175 of three inches will result in the interior side of stud 18 extending a distance 240 of 2½ inches away from inner side 226 of frame unit 20. This provides a service chamber 32 between inner side 226 and interior finish member 38 that has a depth 234 of 2½ inches (reference 234 being shown in FIG. 7 which is illustrated with an interior finish member 38).

Figure 9:
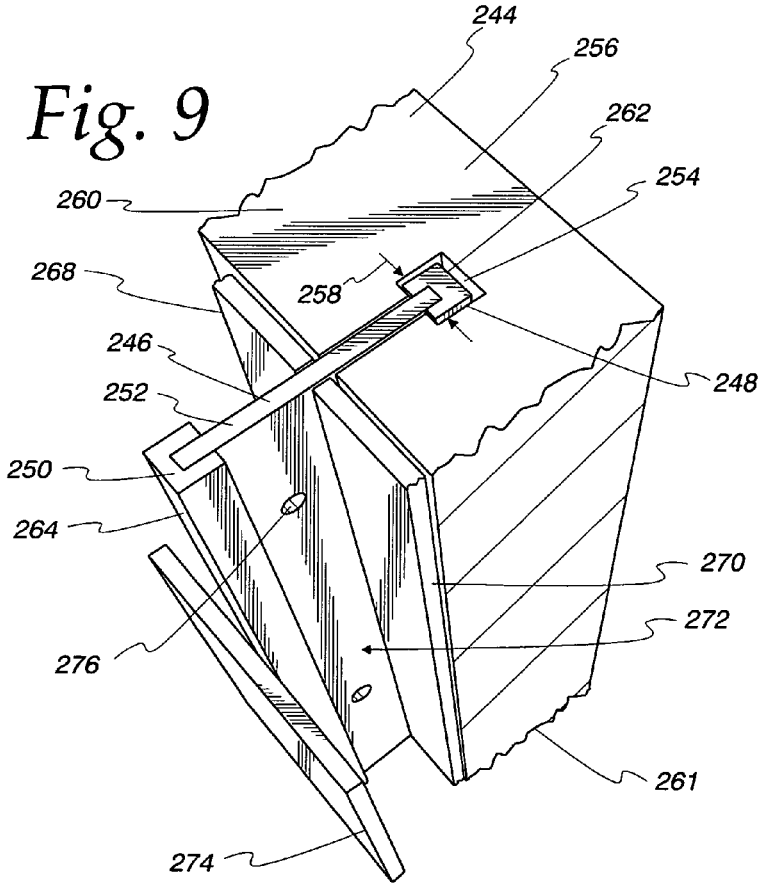
FIG. 9 is a fragmentary top perspective view of another embodiment of a frame unit using a stud formed of engineered lumber to mount the frame unit.

FIG. 9 shows an alternative embodiment for insulated frame unit 20. Insulated frame unit 244 can be used with a stud 246. Stud 246 has a configuration that is typical for studs formed from engineered lumber. Stud 246 has a wood back cap 248 and a wood front cap 250 that are glued to wood plate 252. Stud 246 of engineered lumber can provide increased strength with less shrinkage of stud 246. Thus, less settling of building 10 takes place due to a later shrinkage of studs 246. A generally T-shaped stud-receiving opening 254 is provided in panel 256 of frame unit 244. Stud-receiving opening 254 typically extends from top end 260 of panel 256 to bottom end 261 of panel 256. Panel 256 is formed of the same rigid insulating composition of panel 68 of frame unit 20. Stud-receiving opening 254 is sized with a width 258 that is sufficient to allow stud 246 to be inserted from the top end 260 of panel 256. After stud 246 is inserted into the stud-receiving opening 254, frame unit 244 is positioned between sill 42 and top plate 52 of the building frame and secured in place. Thus, when the exterior side 262 of stud 246 is fully positioned in stud-receiving opening 254, the interior side 264 of stud 246 extends inwardly from the inner side 268 of frame unit 244 at interior sheathing 270. This provides an adequate space for service chamber 272 located between interior sheathing 270 and drywall interior finish member 274 (only partially shown for clarity) secured to interior side 264 of stud 246. Holes 276 in stud 246 are provided for conduits, wires and other utilities as needed.

Figure 8:
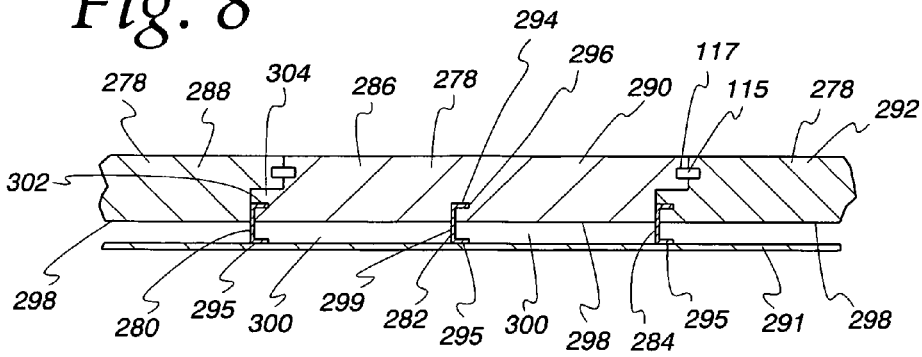
FIG. 8 is a fragmentary top sectional view of another embodiment of three frame units positioned side by side in a row using steel studs to mount the frame units.

FIG. 8 illustrates another embodiment of the invention wherein insulated frame units 278 utilize steel studs 280, 282, 284. Exemplary frame units 288, 290, 292 are similar to frame units 20, except that frame units 288, 290 and 292 are configured to be used with steel studs 280, 282, 284. Frame unit 290 has a stud-receiving opening 296 that extends from top to bottom of inner side 298 of panel 286 of frame unit 290. Panel 286 is formed of the same rigid insulating composition of panel 68 of frame unit 20. Steel stud 282 is inserted to extend the height of inner side 298 of panel 286. Steel stud 282 has an exterior side 294 and an interior side 295 that is connected to exterior side 294 by side 299 of steel stud 282.

Thus, when stud 282 has been inserted into stud-receiving opening 296, interior side 295 is spaced from inner side 298 of panel 286 of frame unit 290. Another steel stud 280 is inserted into a stud-receiving recess 302 formed in a left inner flange 304 of panel 286 of frame unit 290 to thereby mount steel stud 280 to frame unit 290. Thus, when an interior finish member 291, such as drywall, is mounted onto the interior side 295 of each of studs 280, 282, 284, an interior service chamber 300 is provided between interior finish member 291 and the inner side 298 of panel 286 of frame units 288, 290 and 292.

Figure 10:
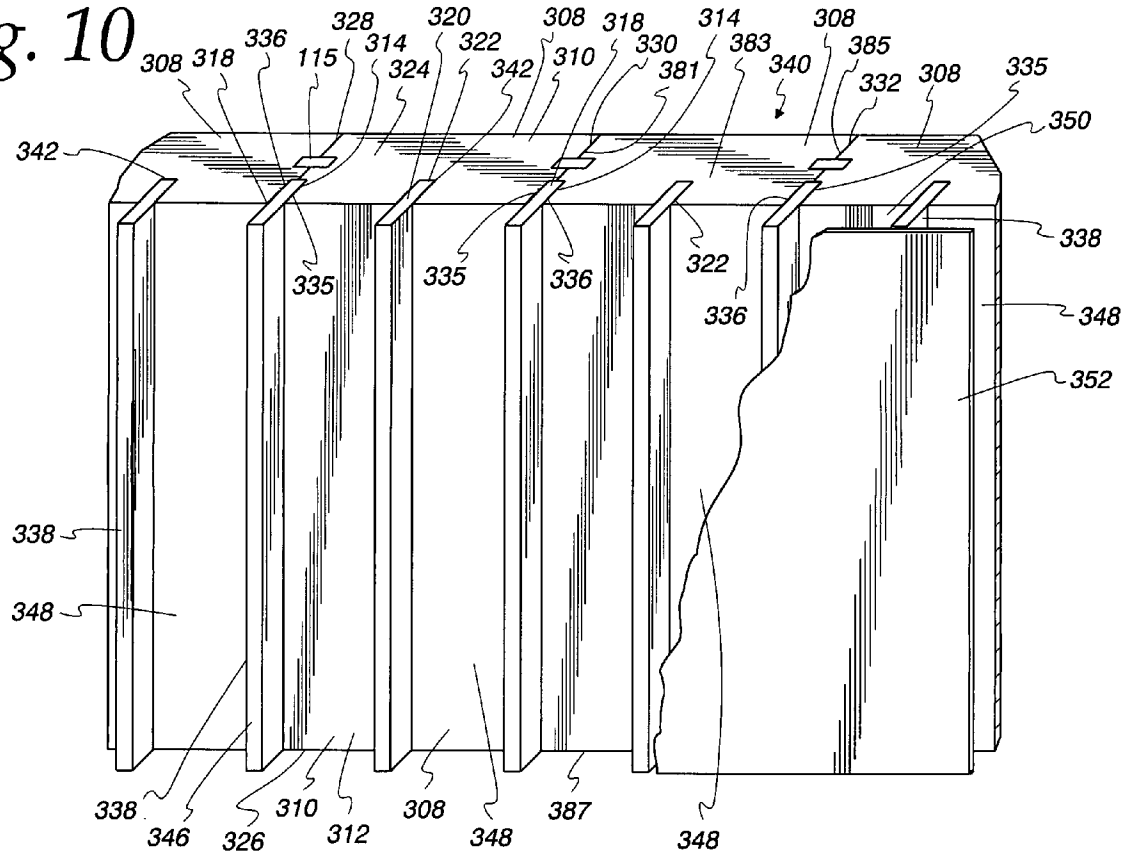
FIG. 10 is a fragmentary perspective view illustrating another embodiment of frame units positioned side by side in a row.

FIG. 10 illustrates an alternative insulated frame unit 308. Frame units 308 each have a panel 310 formed from a rigid insulated material of a composition as described previously regarding panel 68 of frame unit 20. Panel 310 has body 312 with a left stud-receiving recess opening 314, a right stud-receiving recess opening 318, and a stud-receiving opening 320. Stud-receiving opening 320 may be a slot 322 that is centrally located along an inner side 348 of panel 310. Slot 322, left stud-receiving recess 314 and right stud-receiving recesses 318 extend from a top end 324 to a bottom end 326 of body 312 of panel 310. When frame units 308 are positioned side by side in a row, junctions 328, 330 and 332 occur along adjacent panels 310. At each of junctions 328, 330 and 332, left stud-receiving recess 314 cooperates with an adjacent right stud-receiving recess 318, to provide stud-receiving openings 336 in the form of a stud-receiving channel 335. Stud-receiving channels 335 and slots 322 allow frame units 308 to be mounted to studs 338 to enclose an exterior wall 340 of a building.

When the exterior side 342 of stud 338 is fully inserted into one of stud-receiving openings 320, 336, the interior side 346 of stud 338 extends inwardly from inner side 348 of frame units 308. Thus, as previously described, a service chamber 350 is provided between interior finish member 352 and inner side 348 of frame unit 308. Frame units 308 are secured to studs 338 such as by brackets 30 (not shown in FIG. 10) as previously described. Frame units 308 may optionally include interior sheathing 24 and/or exterior sheathing 22 (also not shown in FIG. 10) as previously described. Any or all of ends 381, 383, 385 or 387 of frame units 308 may include tongue and grooves for providing airtight junction when frame units are positioned adjacent each other. Alternatively, ends 381, 383, 385 and 387 may include flanges as described previously in regard to frame unit 20.

Figure 6:
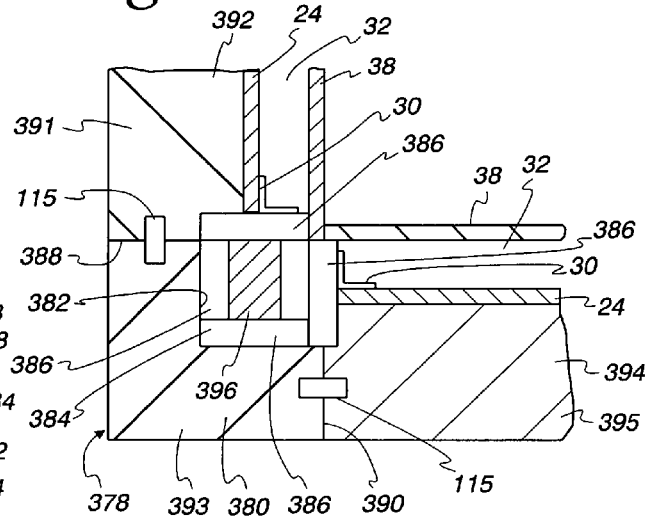
FIG. 6 is a fragmentary top sectional view of another embodiment of three frame units positioned in a corner of a building.
Figure 7:
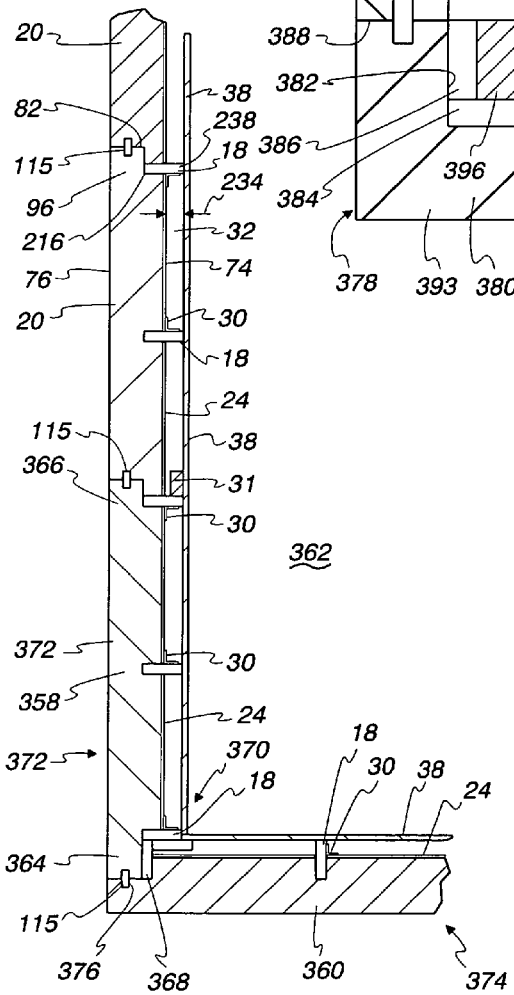
FIG. 7 is a fragmentary top sectional view of another embodiment of three frame units positioned in a corner of a building.

FIG. 6 and FIG. 7 illustrate exemplary frame units 358, 360 and 380 that can be used for enclosing the corner of an exterior wall. Referring to FIG. 7, non-standard corner frame units 358 and 360 are substantially the same as standard frame unit 20. When viewed from a perspective of the interior of the room 362, it is noted that left outer flange 364 of non-standard frame unit 358 is longer than outer flange 96 of standard frame unit 20. The additional length of left outer flange 364 compensates for an additional stud 368 placed at the corner 370 of walls 372 and 374. Also, recess 376 on frame unit 360 for seal member 115 is located for a right angle junction of frame members 358 and 360. It is also noted that for enclosing some configurations of a building frame, such as at corner 370, it may be advantageous to configure a non-standard frame unit, such as frame unit 358, to have two outer flanges 364 and 366. FIG. 6 shows a corner 378 enclosed with a corner frame unit 380 that has an inner corner recess 382 configured for receiving corner support member 384. Corner support member 384 is formed of a plurality of studs 386 for additional corner load bearing. Seal members 115 are provided at the junctions 388 and 390 between corner frame unit 380 and frame units 392 and 394, respectively. Studs 386, forming corner support member 384 may also include an additional insulating member 396 for additional insulation. Panels 391, 393 and 395 are formed of the same rigid insulating composition as described for panel 68 of frame unit 20.

Referring to the figures generally and in particular FIGS. 1 and 2, it can be appreciated that once framed wall 14 of building 10 has been constructed, frame units 20 can be installed to enclose wall 14. To avoid confusion, as shown in FIGS. 1 and 2, for descriptive purposes certain studs 18 and other frame elements were omitted in places. Generally, frame units 20 will be installed to a wall 14 only after the frame of wall 14 has been fully completed. In a typical installation process, a workman conducting the installation is positioned on the exterior of building 10. A supply of frame units 20 to be mounted to wall 14 is also positioned on the exterior of building 10. This is because frame units 20 will be installed face first onto the exterior side of framed wall 14. Stated another way, inner side 226 of frame unit 20 is installed by inward movement toward exterior side 216 of studs 18 of framed wall 14. As mentioned previously, the inner side of frame unit 20 will be the inner side 74 of panel 68 when optional interior sheathing 24 is not included for frame unit 20. When interior sheathing 24 is included, the inner side 226 of frame unit 20 will be the inner side 228 of interior sheathing 24. Stud-receiving openings 150 and 152 are aligned with the respective studs 18 that are to be received into stud-receiving openings 150 and 152. Thereafter, the workman pushes against the outer side 76 of panel 68, or against exterior sheathing 22, if optional exterior sheathing 22 is included on frame unit 20. The inward pushing motion moves frame unit 20 inwardly until continued forward movement is prevented when studs 18 are fully inserted within stud-receiving openings 150 and 152. Typically, this occurs when exterior sides 216 of studs 18 respectively engage back sides 220 and 222 of stud-receiving openings 150 and 152. Once so engaged, a third stud 18 is located proximate to, if not in contact with, edge 200 of left inner flange 92. It is again noted that when a frame unit 20 is installed on a bottom row, preferably bottom outer flange 106 of frame unit 20 extends in close engagement along outer edge 116 of sill 42, and in close engagement along the outer surface 118 of foundation wall 120. This provides a highly insulated and airtight wall 14 adjacent the bottom end 122 of wall 14.

In a like manner, additional frame units 20 are installed in the bottom row to enclose the bottom area of exterior wall 14 of building 10. As described above, the inner flange 92 is located on the left side of frame unit 20. Thus, it will be appreciated that it will be advantageous to install a row of frame units 20 working from left to right from a perspective from the outside of the building 10. However, it is understood that the invention is not to be limited to inner flange 92 being located on the left side of frame 20 and outer flange 96 being located at the right side of frame unit 20. Frame units 20 can be formed with a reverse orientation, i.e. with inner flange 92 being formed on the right side end of frame unit 20, and with outer flange 96 being formed on the left side end of frame 20.

From time to time, a workman from the inside of building 10 will secure frame units 20 to studs 18 by installing brackets 30, such as by fastening bracket 30 with a fastener to stud 18. Bracket 30 is also fastened to frame unit 20, such as at interior sheathing 24. After one or more frame units 20 are installed in a bottom row, additional frame units may be stacked vertically upward in a column. Stacking a frame unit 20 on top of a lower installed frame unit 20 is accomplished in similar manner to forming a row. One difference is that outer bottom end flange 106 of frame unit 20 overhangs and engages inner top end flange 102 of frame unit 20 of the lower frame unit 20, rather than sill 42.

Non-standard frame units 134 are used in corners 144, around window opening 140, door openings and where otherwise required to finish enclosing wall 14. Interior finish member 38 is installed to studs 18. As previously described, interior finish member 38 is spaced from the inner side 226 of frame member 20 to provide service chamber 32. An exterior finishing member 28 is applied to outer side 76 of panel 68 of frame unit 20. Typically, if wood siding is the façade, frame unit 20 will include outer sheathing 22. Certain other types of façade, such as synthetic stucco, may be applied directly to outer side 76 of panel 68 without using outer sheathing 22.

While the invention has been described with respect to certain preferred embodiments, it is to be understood that the invention is capable of numerous changes, modifications, and rearrangements without departing from the scope or spirit of the invention as defined in the claims.

What is claimed is:

1. An insulated frame unit for use in constructing an exterior wall of a building that has an exterior finish member for the exterior of the building and an interior finish member for the interior room that is defined by the wall, the wall including a plurality of spaced apart generally vertical studs, the studs having an exterior side facing the exterior of the building and an opposed interior side facing the interior room, and the studs having a generally predetermined thickness, predetermined width, and spacing between the studs of at least about 12 inches, the frame unit comprising:

a panel composed substantially of a rigid foam insulating material, the panel having first and second generally opposed ends, and third and fourth generally opposed ends, an inner side and an outer side; and at least two stud-receiving openings in the inner side of the panel, the stud-receiving openings generally parallel to each other and extending between the first and second ends of the panel, the stud-receiving openings having a width that is sufficient to allow a stud to be mounted within the stud-receiving openings, and the stud-receiving openings having a depth that is less than the predetermined width of the stud, so that when the exterior side of the stud has been fully inserted into the stud-receiving opening the interior side of the stud is spaced away from the inner side of the panel for providing a service chamber between the inner side of the panel and an interior finish member secured to the interior side of the studs, and whereby an exterior finish member can be secured proximate to the outer side of the panel; and the third end of the panel having a first flange and first recess, and the fourth end of the panel having a second flange and a second recess whereby the first flange of the panel of the insulated frame unit is adaptable to be positioned in the second recess of a second insulated frame unit substantially identical to the insulated frame unit to thereby provide a stud-receiving channel.

2. The insulated frame unit of claim 1 further comprising the panel including an exterior sheathing adhered to the outer side of the panel for attaching an exterior finish member to the outer sheathing.

3. The insulated frame unit of claim 2 further comprising the panel including an interior sheathing adhered to the inner side of the panel and extending between the stud-receiving openings, the interior sheathing for securing to the studs to provide rigidity when a wall is formed from one or more frame units.

4. The insulated frame unit of claim 1 further comprising the panel including an interior sheathing adhered to the inner side of the panel and extending between the stud-receiving openings, the interior sheathing for securing to the studs to provide rigidity when a wall is formed from one or more frame units.

5. The insulated frame unit of claim 1 further comprising the first end, the second end, the third end and the fourth end of the panel each having a flange and a recess to allow the panel to abut with other substantially identical panels when one other panel is positioned adjacent each of the second end, the third end and the fourth end of the panel, the recess of the first end providing a space for allowing a sill to be positioned therein with the flange of the first end for extending below the sill along the exterior side of a foundational wall.

6. The insulated frame unit of claim 5 further comprising the panel including an exterior sheathing adhered to the outer side of the panel for attaching an exterior finish member to the outer sheathing.

7. An insulated frame unit for use in constructing an exterior wall of a building that has an exterior of the building and an interior room that is defined by the wall, the wall including a plurality of spaced apart generally vertical studs, the studs having an exterior side facing the exterior of the building and an opposed interior side facing the interior room, and the studs having generally predetermined thickness, predetermined width, and spacing between the studs greater than about twelve inches, the frame unit comprising:

a panel composed substantially of a rigid insulating material, the panel having a body with first and second generally opposed ends, and third and fourth generally opposed ends, the panel having an inner side and an outer side;

at least first and second stud-receiving openings in the inner side of the panel, the first stud-receiving opening being a slot in the inner side of the panel that is spaced from the third and fourth sides of the body of the panel, the second stud-receiving opening being located along the fourth end of the panel, the stud-receiving openings being generally parallel to each other and extending between the first and second ends of the panel, the stud-receiving openings having a width that is sufficient to allow a stud to be mounted within the stud-receiving openings, a first flange extending outwardly from the third end of the body of the panel adjacent the inner side of the panel, and a second flange extending outwardly from the fourth end of the body of the panel adjacent the outer side of the panel, the length of the second flange being greater than the length of the first flange.

8. The insulated frame unit of claim 7 wherein the rigid insulating material is rigid foam.

9. The frame unit of claim 7 wherein when the third side of the panel of the frame unit is positioned adjacent the fourth side of a second panel of a second frame unit that is substantially identical to the frame unit, the first flange of the third side of the panel is overlapped by the second flange of the fourth side of the second panel of the second frame unit and with the first flange of the panel positioned within the second stud-receiving opening of the second panel of the second frame unit to form a first stud-receiving channel adjacent the third end of the panel, and when the fourth side of the panel is positioned adjacent the third side of a third panel of a third frame unit that is substantially identical to the frame unit, the second flange of the fourth side of the panel overlaps the first flange of the third side of the third panel of the third frame unit and with the first flange of the third side of the third panel of the third frame unit positioned within the second stud-receiving opening of the first panel to form a second stud-receiving channel adjacent the fourth end of the panel.

10. The insulated frame unit of claim 9 wherein the width of the slot is approximately the predetermined thickness of the stud positioned therein to provide an interference fit between the slot and the stud, and the width of each of the first and second stud-receiving channels is approximately the predetermined thickness of a stud received therein for providing an interference fit.

11. The insulated frame unit of claim 9 further comprising the stud-receiving openings having a depth that is less than the predetermined width of the stud, so that when the exterior side of the stud has been fully inserted into the stud-receiving opening the interior side of the stud is spaced away from the inner side of the panel for providing a service chamber between the inner side of the panel and an interior finish member when the interior finish member is secured to the interior side of the studs.

12. The insulated frame unit of claim 11 further comprising a third flange extending outwardly from the first end of the body of the panel adjacent the outer side of the panel and a fourth flange extending outwardly from the second end of the body adjacent the inner side of the panel.

13. An exterior wall construction for a building comprising:

a frame having a plurality of spaced apart generally parallel studs, the studs having an exterior side facing the exterior of the building and an opposed interior side facing an interior of the building, and the studs having a generally predetermined thickness, predetermined width, and spacing between the studs of at least about 12 inches;

first and second insulated frame units, each insulated frame unit comprising a panel composed substantially of rigid insulating material, the panel having first and second generally opposed ends, and third and fourth generally opposed ends, an inner side and an outer side, the panel including a stud-receiving opening in the inner side of the panel, the stud-receiving opening having a stud positioned therein with the interior side of the stud spaced inwardly from the inner side of the panel, the first insulated frame unit positioned adjacent the second insulated frame unit;

an interior finish member secured to the interior side of the stud, the interior finish member spaced from the inner side of the panel to provide a service chamber between the inner side of the panel and the interior finish member; and each of the first and second insulated frame units having a first flange extending outwardly from the third end of the panel adjacent the inner side of the panel, and a second flange extending outwardly from the fourth end of the panel adjacent the outer side of the panel, the length of the second flange being greater than the length of the first flange, the first insulated frame unit positioned adjacent the second insulated frame unit so that the third side of the panel of the first insulated frame unit is adjacent the fourth side of the panel of the second insulated frame unit, and the second flange of the second insulated frame unit overlaps the first flange of the first insulated frame unit to thereby provide the stud-receiving opening.

14. An exterior wall construction for a building comprising:

a frame having a plurality of spaced apart generally parallel studs, the studs having an exterior side facing the exterior of the building and an opposed interior side facing an interior of the building, and the studs having a generally predetermined thickness, predetermined width, and spacing between the studs of at least about 12 inches; and first and second insulated frame units, each of the insulated frame units comprising a panel composed substantially of rigid insulating material, the panel having a body with first and second generally opposed ends, and third and fourth generally opposed ends, the panel having an inner side and an outer side, a first flange extending outwardly from the third end of the body of the panel adjacent the inner side of the panel, and a second flange extending outwardly from the fourth end of the body of the panel adjacent the outer side of the panel, the length of the second flange being greater than the length of the first flange, the first insulated frame unit positioned adjacent the second insulated frame unit so that the third side of the panel of the first insulated frame unit is adjacent the fourth side of the panel of the second insulated frame unit, and the second flange of the second insulated frame unit overlaps the first flange of the first insulated frame unit to thereby provide a stud-receiving opening, and the stud-receiving opening having a stud positioned therein.

15. The exterior wall construction of claim 14 further comprising the stud having an exterior side and an interior side, the exterior side of the stud positioned in the stud-receiving opening and an interior side of the stud spaced inwardly from the inner side of the panel; and an interior finish member secured to the interior side of the stud, the interior finish member spaced from the inner side of the panel to provide a service chamber between the inner side of the panel and the interior finish member.

16. A method of constructing an exterior wall of a building having a frame having a plurality of spaced apart generally parallel studs, the studs having an exterior side facing the exterior of the building and an opposed interior side facing an interior of the building, and the studs having a generally predetermined thickness, predetermined width, and spacing between the studs of at least about 12 inches comprising:

providing a plurality of insulated frame units, each insulated frame unit comprising a panel composed substantially of rigid insulating material, the panel having first and second generally opposed ends, and third and fourth generally opposed ends, an inner side and an outer side, the panel including a stud-receiving opening in the inner side of the panel, providing a first flange extending outwardly from the third end of the panel adjacent the inner side of the panel, and a second flange extending outwardly from the fourth end panel adjacent the outer side of the panel, the length of the second flange being greater than the length of the first flange;

installing the plurality of insulated frame units onto the frame to enclose the frame by installing an insulated frame unit onto the frame by positioning the exterior side of the stud within the stud-receiving opening in the inner side of the panel and with the interior side of the stud spaced from the inner side of the panel;

installing a first insulated frame unit adjacent a second insulated frame unit so that the third side of the panel of the first insulated frame unit is adjacent the fourth side of the panel of the second frame unit and the second flange of the panel of the second insulated frame unit overlaps the first flange of the panel of the first insulating frame unit whereby the overlapping of the second flange of the second insulated frame unit with the first flange of the first frame unit forms the stud-receiving opening; and installing an interior finish member to the interior side of the stud with the interior finish member spaced from the inner side of the panel to provide a service chamber between the inner side of the panel and the interior finish member.

17. A method of constructing an exterior wall of a building having a frame having a plurality of spaced apart generally parallel studs, the studs having an exterior side facing the exterior of the building and an opposed interior side facing the interior of the building, and the studs having a generally predetermined thickness, predetermined width, and spacing between the studs of at least about 12 inches comprising:

providing a plurality of insulated frame units, each insulated frame unit comprising a panel composed substantially of rigid insulating material, the panel having a body with first and second generally opposed ends, and third and fourth generally opposed ends, the panel having an inner side and an outer side, a first flange extending outwardly from the third end of the body of the panel adjacent the inner side of the panel, and a second flange extending outwardly from the fourth end of the body of the panel adjacent the outer side of the panel, the length of the second flange being greater than the length of the first flange;

positioning a first insulated frame unit adjacent a second insulated frame unit so that the third side of the panel of the first insulated frame unit is adjacent the fourth side of the panel of the second frame unit and the second flange of the panel of the second insulated frame unit overlaps the first flange of the panel of the first insulating frame unit whereby the overlapping of the second flange of the second insulated frame unit with the first flange of the first frame unit forms a stud-receiving opening;

positioning a stud within the stud-receiving opening; and securing at least one of the first and second insulated frame units to the stud.

18. The method of claim 17 further comprising the stud having an interior side and an exterior side, and installing the plurality of insulated frame units onto the frame to enclose the frame by installing the insulated frame unit onto the frame by positioning the exterior side of the stud within the stud-receiving opening with the interior side of the stud spaced from the inner side of the panel; and installing an interior finish member to the interior side of the stud with the interior finish member spaced from the inner side of the panel to provide a service chamber between the inner side of the panel and the interior finish member.

* * * * *